US005749488A

United States Patent [19]

Bagwell et al.

[11] Patent Number: 5,749,488

[45] Date of Patent: May 12, 1998

[54] CAN END WITH RECESSED CENTER PANEL FORMED DOWNWARDLY FROM COIN

[75] Inventors: Alan C. Bagwell, Chesterfield County; Daniel A. Edwards, Henrico County, both of Va.

[73] Assignee: Reynolds Metals Company, Richmond, Va.

[21] Appl. No.: 537,484

[22] Filed: Oct. 2, 1995

[51] Int. Cl.[6] ..... B65D 17/34

[52] U.S. Cl. ..... 220/269; 220/906

[58] Field of Search ..... 220/269–273, 220/906, 608, 623; 29/773; 22/348, 356, 375; 413/8, 56, 62

[56] References Cited

U.S. PATENT DOCUMENTS

| | | | |
|---|---|---|---|
| 3,404,801 | 10/1968 | Silver | 200/269 |
| 3,417,898 | 12/1968 | Bozek et al. | 220/623 |
| 3,674,171 | 7/1972 | Fahlbusch | 220/623 X |
| 3,774,801 | 11/1973 | Gedde | 220/623 |
| 3,858,754 | 1/1975 | Patarini et al. . | |
| 3,967,752 | 7/1976 | Cudzik . | |
| 4,010,867 | 3/1977 | Jones | 220/608 |
| 4,015,744 | 4/1977 | Brown . | |
| 4,024,981 | 5/1977 | Brown . | |
| 4,030,631 | 6/1977 | Brown . | |
| 4,093,102 | 6/1978 | Kraska | 220/623 |
| 4,141,462 | 2/1979 | Rucci | 220/713 X |
| 4,257,529 | 3/1981 | Saunders . | |
| 4,266,688 | 5/1981 | Reid . | |
| 4,276,993 | 7/1981 | Hasegawa . | |
| 4,416,389 | 11/1983 | Wilkinson et al. . | |
| 4,448,322 | 5/1984 | Kraska | 220/623 |
| 4,467,933 | 8/1984 | Wilkinson et al. | 220/623 |
| 4,577,774 | 3/1986 | Nguyen | 220/623 |
| 4,596,342 | 6/1986 | Zysset | 220/273 |
| 4,796,772 | 1/1989 | Nguyen | 220/623 |
| 5,046,637 | 9/1991 | Kysh | 72/348 X |
| 5,129,541 | 7/1992 | Voigt et al. . | |
| 5,145,086 | 9/1992 | Krause | 220/270 |
| 5,331,836 | 7/1994 | Cudzik . | |
| 5,356,256 | 10/1994 | Turner et al. | 72/348 X |
| 5,527,143 | 6/1996 | Turner et al. | 72/348 X |

FOREIGN PATENT DOCUMENTS

| | | | |
|---|---|---|---|
| 586656 | 3/1989 | Japan | 220/269 |
| 182247 | 7/1989 | Japan | 220/269 |
| 88/05407 | 7/1988 | WIPO | 220/269 |

*Primary Examiner*—Allan N. Shoap
*Assistant Examiner*—Nathan Newhouse
*Attorney, Agent, or Firm*—Robert C. Lyne, Jr.

[57] ABSTRACT

An easy open construction for a can end wherein a tear panel principally defined by a rupturable score line in a central panel of a wall is opened by operating a tab having one end adapted to press against the tear panel at a position spaced from the score line and overlying only a small portion of the opening left by the tear panel in its open position. The other end of the tab constitutes a finger gripping portion which is manually liftable to open the tear panel and may be returnable directly to its original position next to the wall. The tab and tear panel remain secured to the wall after the tear panel has been moved to its open position. The central panel is defined by a coined area and a downwardly recessed area located immediately radially inwardly adjacent the coined area. The finger gripping portion elevation relative to the top of the end seaming panel is relocated away from the seam as a result of this downward recessed area. Adequate finger gripping clearance beneath the portion is provided through a number of different configurations without the need for tab tip-up. In yet another embodiment, the tab and tear panel are located within a second recessed area recessed downwardly from the surrounding recessed area and in which tab tip-up is required to create finger access.

22 Claims, 4 Drawing Sheets

Fig. 1A
(PRIOR ART)
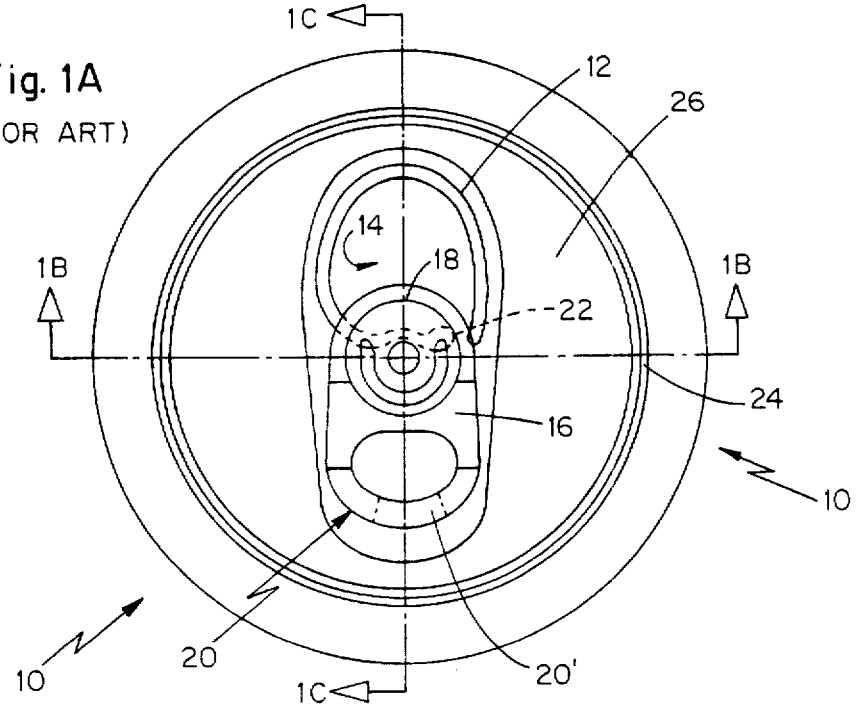
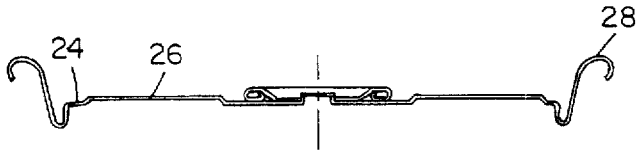
Fig. 1B (PRIOR ART)
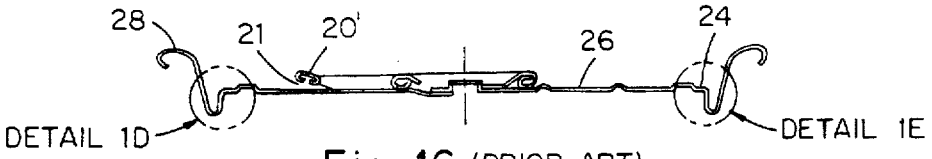
Fig. 1C (PRIOR ART)
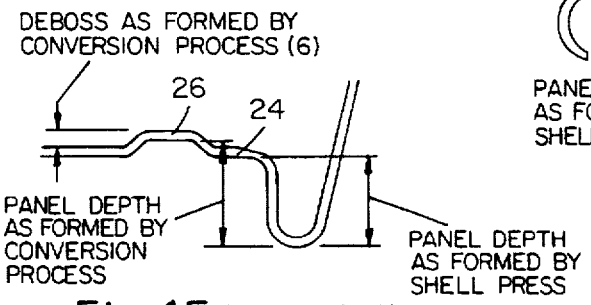
Fig. 1E (PRIOR ART)
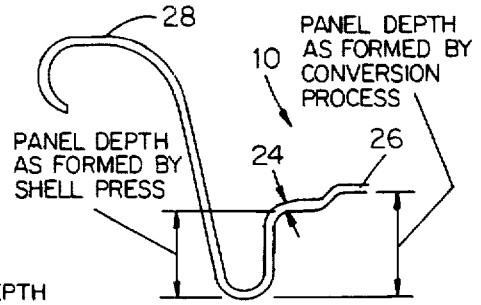
Fig. 1D (PRIOR ART)

CAN END WITH RECESSED CENTER PANEL FORMED DOWNWARDLY FROM COIN

TECHNICAL FIELD

The present invention relates generally to the manufacture of can ends for metal containers and, more particularly, to easy open can ends equipped with a stay on tab.

BACKGROUND ART

FIGS. 1A–1E are illustrations of a known can end 10 designed to be secured to the top edge of a container cylindrical side wall to seal a beverage or the like therein in accordance with known manufacturing techniques that form no part of the present invention. Prior art can end 10 is formed with a score line 12 defining most of the periphery of a non-removable tear panel 14 which is partially severable from the can end wall to define an opening therein through which contents of the container can be dispensed. End 10 has a tab 16 which is attached thereto in a non-detachable manner adjacent to tear panel 14 and the tab has a forward nose portion 18 overlying only a minor part of the tear panel 14. The rear or tail portion 20 of the tab 16 is a finger gripping portion that is adapted to be easily grasped and lifted to urge the forward nose portion 18 downwardly against the tear panel 14 for movement of the tear panel downwardly into the container interior as the major portion of the tear panel severs along the score line 12. Such movement occurs along a bend area or integral hinge 22 between the tear panel 14 and the remainder of the end wall. The length of this hinge 22 will be seen to be substantially less than the maximum dimension of the tear panel 14.

It is highly desirable to work harden the annular peripheral band 24 of the center panel with a coining process to increase the buckle pressure of the end 10 (e.g. by approximately 3 to 5 psi). However, formation of this coin 24 produces a loose center panel which must be tightened to an acceptable level to avoid adversely affecting opening performance of the can end 10. To tighten the center panel, a known secondary forming conversion process is utilized to create a second center panel raised area 26 concentric with both the coin region 24 and the center panel diameter. Unfortunately, this prior art conversion process locates the raised secondary panel 26 elevationally closer to the seaming panel 28. Furthermore, to provide better finger access to the tail portion 20 of the tab 16, the rear 20 of the tab is bent upward toward the seaming panel 28 as best depicted in FIG. 1C. This is known in the art as 'tab tip-up'.

Since the tab elevation is located closer to the seaming panel 28, it has been discovered that the end 10 tends to accidentally open during the pasteurization process where the closed can contents are heated to approximately 240° F., actually creating a high pressure within the filled container which causes the end to bulge outward and which actually raises the tab 16 closer to the seaming panel 28. In some cases, the pressure bulge created in the center of the can actually forces the nose 18 of the tab 16 higher to an elevational position above the seaming panel 28. When this condition incurs, the tab 16 can catch on outside objects, such as the discharge conveyer on which the container exits the pasteurizer in an upside down condition.

It is accordingly a primary object of the present invention to locate the stay on tab away from the seaming panel to prevent the tab from accidentally catching on outside objects, particularly during pasteurization.

Another object is to prevent the tab from catching on outside objects by maximizing the distance between the tab tip-up and the top of the seaming panel.

A further object is to locate the finger gripping portion of the tab within a can end formed with a coined area away from the seaming panel to prevent the tab from catching on outside objects, while providing sufficient finger gripping access.

Yet a further object of the invention is to relocate the tab elevation away from the top of the seaming panel to prevent accidental opening of the end during the pasteurization process where the closed can contents are heated and pressure is created tending to bulge the can end closer to the finished seam.

SUMMARY OF THE INVENTION

An easy open container end with a nondetachable tab for making an opening therethrough suitable for pouring, comprises, in accordance with the present invention, an end wall formed with a central panel and a seaming panel, and a rupturable score line in the central panel defining most of the periphery of a nonremovable tear panel, while leaving an integral hinge between the panel and the remainder of the end wall. The score line extends away from one end of the hinge, around a bight where it is distant from the hinge and back to the other end of the hinge. The tab extends parallel and close to an underlying area of the end wall. A rear part of the tab defines a finger gripping portion being engagable for upward lifting and a forward part of the tab overlies a minor portion of the tear panel. Attaching means on the end wall is provided in a region thereof adjacent the score line outside the tear panel. The attaching means is non-detachably secured to connecting means on the tab. The attaching and connecting means permit pivotal movement of the tab when the rear part of the tab is lifted up from the container and while the forward end of the tab correspondingly swings down. The score line is subject to initial rupture when the rear end of the tab is partially lifted to cause the forward end of the tab to press down on the panel. Continued pivotal movement of the tab, about an axis generally parallel to the underlying area of the end wall and close to the said attachment means, is effective to propagate the rupture of the score line and to swing the panel down about it is hinged to the open position.

The end wall is formed with a coined area around the circumference of the central panel to increase buckle. Since this coin produces a loose central panel, the panel is tightened to an acceptable level through at least one downwardly recessed area defining the central panel and formed immediately radially inwardly adjacent the coined area.

In certain embodiments of this invention, the finger gripping portion overlies the recessed area and a remaining major portion of the tab overlies a second portion of the central panel located radially inwardly adjacent the recessed area. The second portion is elevationally closer to the seaming panel than the recessed area to create adequate finger gripping room without requiring the finger gripping portion to extend in a tab tip-up condition. That is, the upper surface of the finger gripping portion is substantially parallel to the plane of the uppermost surface of the seaming panel.

The second portion may be connected to the coined area through a third portion having the same elevation as the second portion. In a more preferable embodiment, however, the second portion is completely surrounded by the recessed area and is formed in a step of a conversion process subsequent to the step used to coin the recessed area.

In accordance with a further embodiment of the invention, the tab and the tear panel are formed in a second portion of the central panel which is recessed downwardly from and completely surrounded by the said recessed area. In this embodiment, the tab finger gripping portion is tilted into a tab tip-up condition to create adequate finger access. However, the feature of forming the second portion recessed downwardly from the first recessed area provides an elevation counter measure for tipping the tab upward.

Still other objects and advantages of the present invention will become readily apparent to those skilled in this art from the following detailed description, wherein only the preferred embodiments of the invention are shown and described, simply by way of illustration of the best mode contemplated of carrying out the invention. As will be realized, the invention is capable of other and different embodiments, and its several details are capable of modifications in various obvious respects, all without departing from the invention. Accordingly, the drawing and description are to be regarded as illustrative in nature, and not as restrictive.

BRIEF DESCRIPTION OF DRAWINGS

FIG. 1A is a top plan view of an easy open container end formed with a coined area in accordance with a conventional practice;

FIG. 1B is a sectional view taken along the line 1B—1B of FIG. 1A;

FIG. 1C is a sectional view taken along the line 1C—1C of FIG. 1A;

FIG. 1D is a detail taken from FIG. 1C;

FIG. 1E is another detail taken from FIG. 1C;

BEST MODE FOR CARRYING OUT THE INVENTION

Figure 2A:
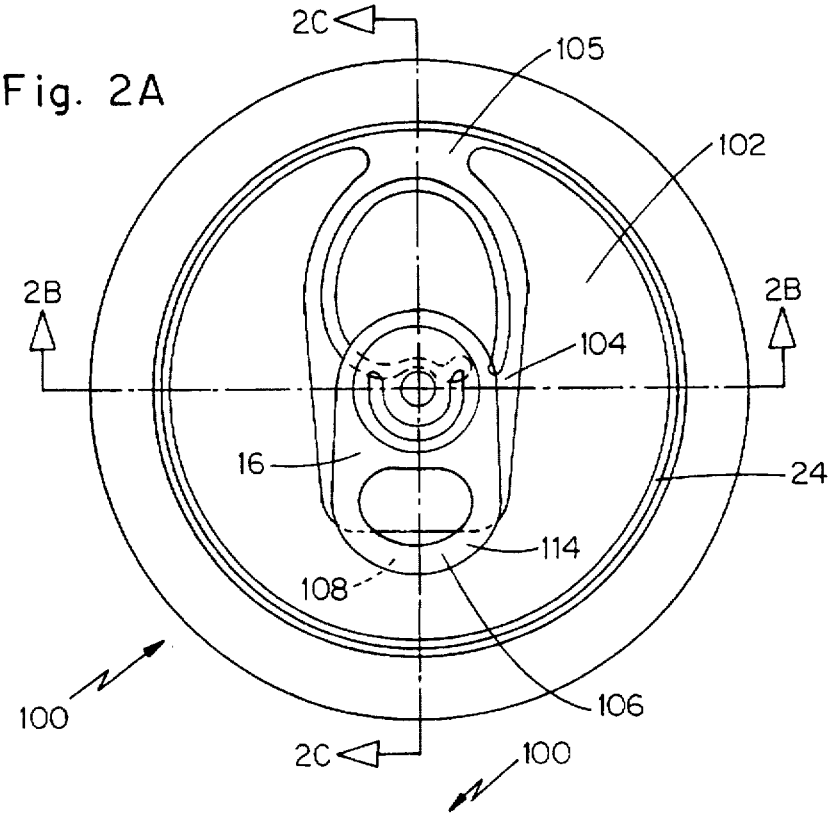
FIG. 2A is a top plan view of a first embodiment of the present invention.

FIGS. 2–4 are illustrations of several embodiments of a can end formed with a coin 24 to increase buckle resistance as discussed above in connection with FIG. 1, with additional unique improvements for tightening the center panel to an acceptable level so that the tab 16 avoids catching outside objects such as during exit from a pasteurizer.

A can end 100 in accordance with a first embodiment depicted in FIGS. 2A–2E can be manufactured, for example, in the same type of shell press used to manufacture can ends 10. An exemplary shell press is disclosed, for example, in U.S. Pat. No. 5,331,836 to Daniel Cudzik, issued Jul. 26, 1994, assigned to Reynolds Metals Company, Richmond, Va, the assignee of the present invention. Therefore, prior to coining and prior to subsequent reforming in a conversion process described hereinbelow, the shell pressed ends used to form ends 100 would have the same panel depth D and the same seaming panel depth D1 as the ends 10.

Figure 2B:
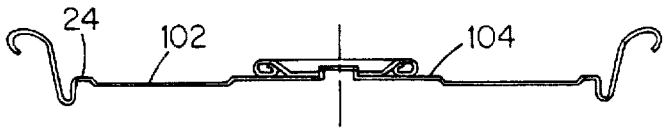
FIG. 2B is a sectional view taken along the line 2B—2B of FIG. 2A.
Figure 2C:
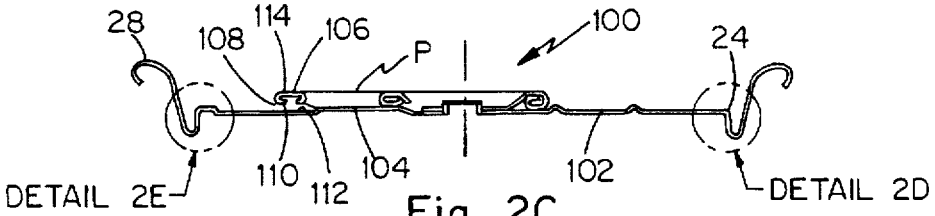
FIG. 2C is a sectional view taken along the line 2C—2C of FIG. 2A.
Figure 2D:
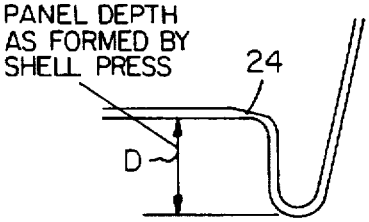
FIG. 2D is a partial sectional view taken from a section 2D of FIG. 2C.
Figure 2E:
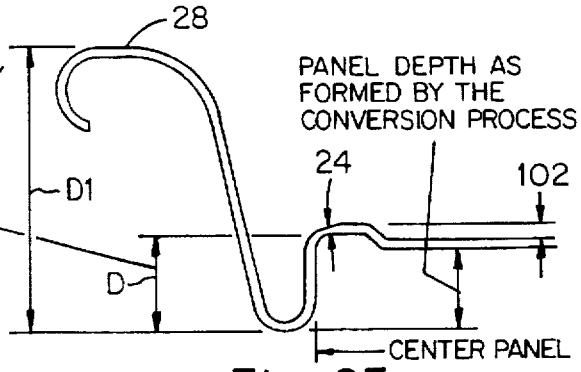
FIG. 2E is a partial sectional view taken from a section 2E of FIG. 2C.
Figure 3A:
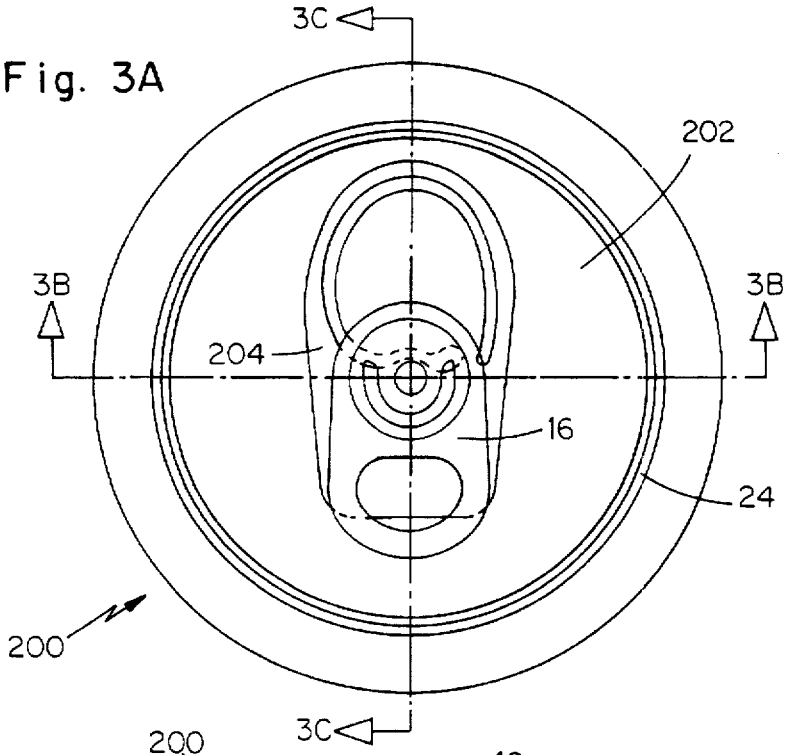
FIG. 3A is a top plan view of a second embodiment of the present invention.
Figure 3B:
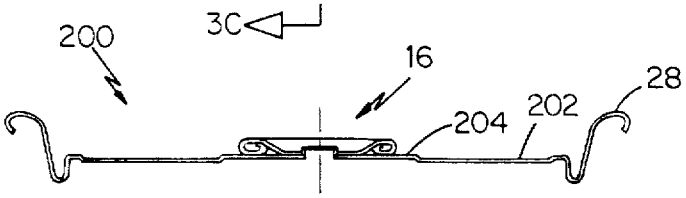
FIG. 3B is a sectional view taken along the line 3B—3B of FIG. 3A.
Figure 3C:
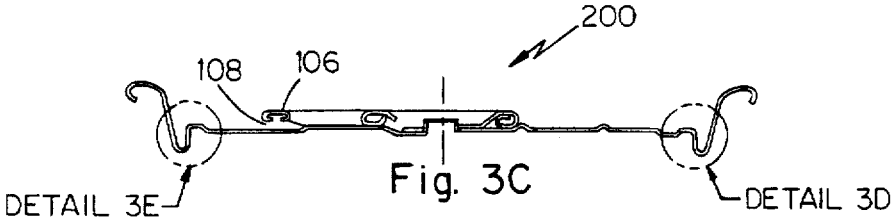
FIG. 3C is a sectional view taken along the line 3C—3C of FIG. 3A.
Figure 3D:
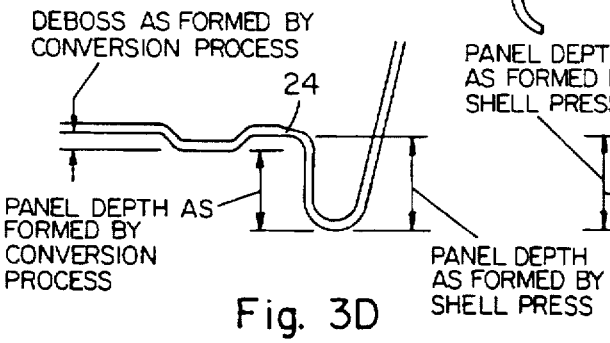
FIG. 3D is a partial sectional view taken from a section 3D of FIG. 3C.
Figure 3E:
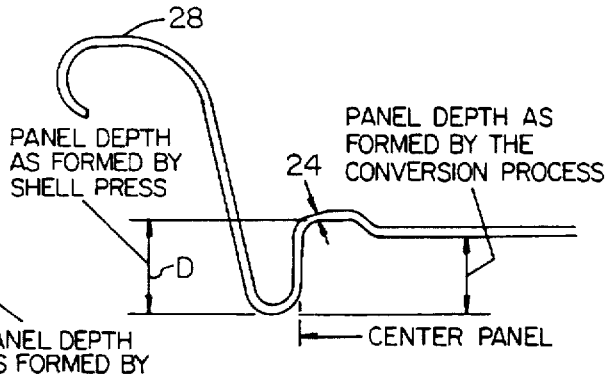
FIG. 3E is a partial sectional view taken from a section 3E of FIG. 3C.

To form the ends 100, the shell pressed ends are processed in a conversion press in which the center panel is tightened by being formed into a recessed area 102 disposed elevationally lower than the panel depth D formed previously within the shell press as best depicted in FIGS. 2A and 2B. With reference to FIG. 2A, this conversion process recesses the entire area 102 of the center panel delineated by shading, i.e., the major portion of the center panel with the exception of the center area 104 on which the tab 16 is formed. This center area 104 remains at essentially the same level D as the coin 24, as best depicted in FIGS. 2B and 2C. However, in accordance with the instant invention, it will be noted that the finger gripping portion 106 of the tab 16 overlies the recessed area 102 of the center panel which advantageously creates a clearance 108 (FIG. 2C) between the bottom surface 110 of the finger gripping portion 106 and the upward facing surface 112 of the recessed area 102 that is approximately at least as large as the maximum clearance 21 beneath the finger gripping portion 20' formed between the radially outwardmost portion of the tab 20 with the raised area 26 in the end 10 (FIG. 1C). Stated differently, the feature of locating the finger gripping portion 106 of the tab 16 radially outward from the outermost edge of the nonrecessed area 104, i.e., thereby overlying the recessed area 102, provides adequate finger access without tipping up the tab as necessary in the prior art can end 10.

In accordance with this embodiment, the entire top surface 114 of the finger gripping portion 106 is disposed within a plane P located a distance D1-D beneath the uppermost surface of the seaming panel 28, whereas the outermost portion of the tip-up finger portion 20' of end 10 is located above plane P, i.e., elevationally closer to the uppermost portion of the seaming panel 4, increasing the likelihood of catching on external objects.

The conversion process necessary to form ends 100 in accordance with the first embodiment of the invention will now be obvious to an end maker of ordinary skill in the art upon review of the drawing illustrations appearing in FIGS. 1A–1E and 2A–2E.

FIGS. 3A–3E are illustrations of a second embodiment of the invention wherein an end 200 is formed with a circular recessed area 202 that entirely surrounds the non-recessed area 204 on which the tab 16 is formed. In the forming process of end 200, the entire center panel area within coin 24 is formed as a recessed area 202 within a conversion process. The non-recessed area 204 is then formed in a subsequent step of the conversion process as a deboss area whereas, in the first embodiment of end 100, the non-recessed area 104 is formed within the shell press and therefore does not include a deboss. The end 200 is therefore easier to manufacture than the end 100 since, in the FIG. 3 embodiment of end 200, the deboss is formed in the normal conversion sequence in a separate operation subsequent to the formation of the recessed area 202. In contrast, in the FIG. 2 embodiment of end 100, since the recessed area 102 and the non-recessed area 104 are formed at the same time, the step feature 105 (i.e., the non-recessed area portion joined to the coin 24) is out of sequence in the conversion process, requiring many tool parts to make the change.

Figure 4A:
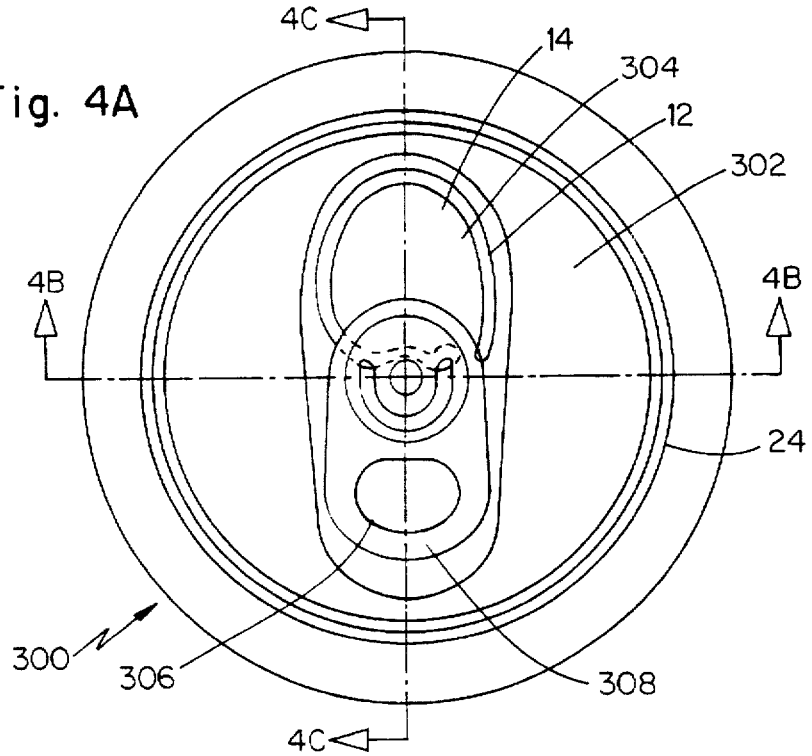
FIG. 4A is a top plan view of a fourth embodiment of the present invention.
Figure 4B:
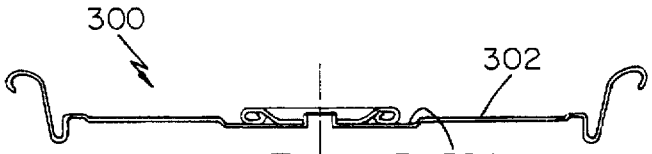
FIG. 4B is a sectional view taken along the line 4B—4B of FIG. 4A.
Figure 4C:
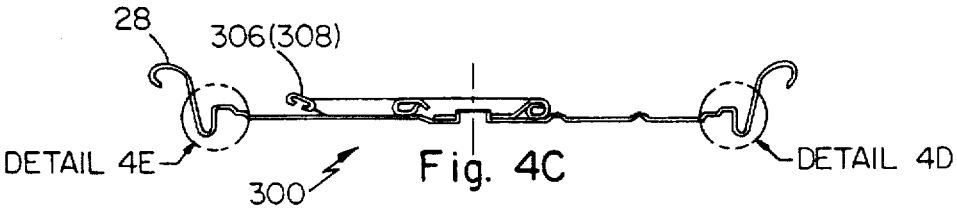
FIG. 4C is a sectional view taken along the line 4C—4C of FIG. 4A.
Figure 4D:
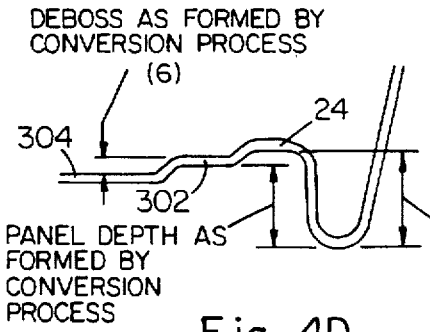
FIG. 4D is a partial sectional view taken from a section 4D of FIG. 4C.
Figure 4E:
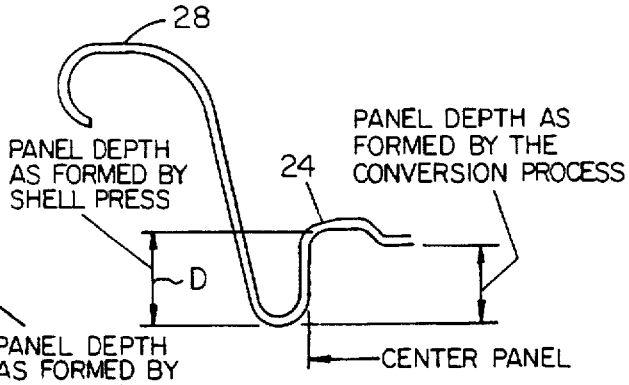
FIG. 4E is a partial sectional view taken from a section 4E of FIG. 4C.

Reference is now made to FIGS. 4A–4E, wherein an end 300 according to a third embodiment is formed with a first downwardly recessed area 302 bounded by coin 24 and formed in a subsequent conversion step. Following formation of this first recessed area 302, a deboss 304 is formed in a separate operation in the downward direction relative to recessed area 302. The tab 306 is subsequently formed in the conventional manner and, to provide finger access beneath the finger gripping portion 308 of the tab and the underlying deboss area 304, it is necessary to create a tip-up condition as depicted in FIG. 4C. Although the structure and methodology of the third embodiment does not utilize the unique deboss shape described hereinabove in connection with the FIG. 2 and 3 embodiments, it nonetheless provides an elevation countermeasure for tipping the tab 306 upward to achieve finger access since the deboss area 304 underlying the tab is formed in a downwardly recessed condition from the recessed area 302.

In summary, therefore, the advantages of the present invention are applicable to can ends in which a coin 24 is created to improve buckle pressure, necessitating the need to tighten up the center panel within the coin to absorb the slack created during the coining process. The elevation of the finger gripping portion of the tab is lowered in relation to the elevation of the seaming panel 28 by forming the area bounded by the coin 24 as a downwardly recessed area and by locating the finger gripping portion in a position overlying the recessed area so as to avoid necessitating the tab tip-up condition. In a subsequent (third) embodiment, the advantages of the invention are achieved by creating the tab tip-up condition for improved finger access albeit within a lowermost of two recessed areas.

Since the invention uniquely lends itself for use with coined can ends, it is conducive to reductions in metal gauge for manufacture of thinner can ends without sacrificing requisite strength while achieving metal savings.

It will be readily seen by one of ordinary skill in the art that the present invention fulfills all of the objects set forth above. After reading the foregoing specification, one of ordinary skill will be able to effect various changes, substitutions of equivalents and various other aspects of the invention as broadly disclosed herein. It is therefore intended that the protection granted hereon be limited only by the definition contained in the appended claims and equivalents thereof.

What is claimed is:

1. An easy-open container end with a non-detachable tab for making an opening therethrough suitable for pouring, comprising:

an end wall formed with a center panel and a seaming panel, a rupturable score line in the center panel defining most of the periphery of a nonremovable tear panel, while leaving an integral hinge between the panel and the remainder of the end wall, said score line extending away from one end of the hinge, around a bight where it is distant from the hinge, and back to the other end of the hinge, said tab extending generally parallel and close to an underlying area of the end wall, a rear part of the tab defining a finger gripping portion being engageable for upward lifting, and a forward part of the tab overlying a minor portion of the tear panel, and attaching means on the end wall in a region thereof adjacent the score line and outside the tear panel, said attaching means being nondetachably secured to connecting means on the tab, said attaching and connecting means permitting pivotal movement of the tab when the rear part of the tab is lifted up from the container and, while the forward end of the tab correspondingly swings down, the score line being subject to initial rupture when the rear end of the tab is partially lifted to cause the forward end of the tab to press down on the panel, continued pivotal movement of the tab, about an axis generally parallel to the underlying area of the end wall and close to the said attaching means, being effective to propagate the rupture of the score line and to swing the panel down about its hinge to open position, and wherein said end wall is formed with a coined area substantially entirely circumscribing the center panel, and at least one downwardly recessed area defining a major portion of said center panel and being formed immediately radially inwardly adjacent the coined area.

2. The easy open container end of claim 1, wherein said finger gripping portion overlies said recessed area and a remaining major portion of said tab overlies a second portion of said center panel located radially inwardly adjacent the recessed area, wherein said second portion is elevationally closer to the seaming panel than said recessed area.

3. The easy open container end of claim 2, wherein said finger gripping portion extends in a non-tab tip-up condition and is thereby generally parallel to the seaming panel.

4. The easy open container end of claim 2, wherein upper surface of said finger gripping portion is substantially parallel to the plane of the uppermost surface of the seaming panel.

5. The easy open container end of claim 2, wherein said second portion is connected to the coined area through a third portion having the same elevation as the second portion.

6. The easy open container end of claim 1, wherein said tab end and said tear panel are formed in a second portion of said center panel which is recessed downwardly from and completely surrounded by said recessed area.

7. The easy open container end of claim 6, wherein said tab finger gripping portion is tilted into a tab tip-up condition.

8. The easy open container end of claim 7, wherein said tab finger gripping portion completely overlies said second portion.

9. The easy open container end of claim 1, wherein the greater part of said tear panel is outside of the area covered by the tab in its initial position and extends away from said area toward said bight, wherein said initial rupture of the score line occurs in a region adjacent one end of said hinge and further wherein the initial rupture is propagated throughout the entire length of the score line between the ends of said hinge.

10. The easy open container end of claim 9, wherein said attaching means comprises a rivet integrally formed in about the center of said end wall.

11. The easy open container end of claim 9, wherein said tab forward part has a generally arcuate periphery that is urged against the tear panel as said tab rear part is lifted up to effect said initial rupture and the propagation thereof.

12. The easy open container end of claim 9, wherein said tab is adapted to be returned toward a position generally parallel and close to an underlying area of the end wall, after the score line is ruptured, and the tear panel is swung downwardly, without causing return movement of said tear panel toward said end wall.

13. The easy open container end of claim 1, wherein the length of said hinge is substantially less than the maximum dimension of the tear panel.

14. The easy open container end of claim 1, wherein a place on the tear panel where the forward part of the tab initially presses is spaced from the score line, and wherein said attaching means on the end wall is close to the score line.

15. The easy open container end of claim 1, wherein said forward part of the tab overlies at least a portion of said hinge.

16. The easy open container end of claim 1, wherein said attaching means on the end wall is a rivet integral with the end wall, and said connecting means on the tab comprise a connection having a hole receiving said rivet.

17. The easy open container end of claim 1, wherein said attaching means on the end wall is a rivet integral with the end wall, and said connecting means on the tab comprises a bendable extension of the tab secured to the rivet.

18. The easy open container end of claim 1, wherein said recess area is formed in a conversion process.

19. The easy open container end of claim 2, wherein said recessed area is formed in a conversion process step and said second portion is formed in a separate and subsequent second conversion process step.

20. The easy open container end of claim 1, wherein said at least one downwardly recessed area defining said center panel is coextensive with at least a major extent of the coined area and thereby bounded by said coined area.

21. The easy open container end of claim 20, wherein said at least one downwardly recessed area is coextensive with substantially the entire extent of the coined area.

22. An easy-open container end with a non-detachable tab for making an opening therethrough suitable for pouring, comprising:

an end wall formed with a center panel and a seaming panel, a rupturable score line in the center panel defining most of the periphery of a nonremovable tear panel, while leaving an integral hinge between the panel and the remainder of the end wall, said score line extending away from one end of the hinge, around a bight where it is distant from the hinge, and back to the other end of the hinge, said tab extending generally parallel and close to an underlying area of the end wall, a rear part of the tab defining a finger gripping portion being engageable for upward lifting, and a forward part of the tab overlying a minor portion of the tear panel, and attaching means on the end wall in a region thereof adjacent the score line and outside the tear panel, said attaching means being nondetachably secured to connecting means on the tab, said attaching and connecting means permitting pivotal movement of the tab when the rear part of the tab is lifted up from the container and, while the forward end of the tab correspondingly swings down, the score line being subject to initial rupture when the rear end of the tab is partially lifted to cause the forward end of the tab to press down on the panel, continued pivotal movement of the tab, about an axis generally parallel to the underlying area of the end wall and close to the said attaching means, being effective to propagate the rupture of the score line and to swing the panel down about its hinge to open position, and wherein said end wall is formed with a coined area substantially entirely circumscribing the center panel, and at least one downwardly recessed area defining said center panel and being formed immediately radially inwardly adjacent the coined area, wherein said finger gripping portion overlies said recessed area and a remaining major portion of said tab overlies a second portion of said center panel located radially inwardly adjacent the recessed area, wherein said second portion is elevationally closer to the seaming panel than said recessed area, wherein said second portion is completely surrounded by said recessed area.

* * * * *